United States Patent [19]

Chaun-Tien

[11] Patent Number: 4,838,553

[45] Date of Patent: Jun. 13, 1989

[54] FISHING TOY

[76] Inventor: Chuang Chaun-Tien, 22296 S De Anza Cir., Cupertino, Calif. 95014

[21] Appl. No.: 155,090

[22] Filed: Feb. 11, 1988

[30] Foreign Application Priority Data

Aug. 22, 1987 [TW] Taiwan ..... 76208181

[51] Int. Cl.[4] ..... A63F 9/00

[52] U.S. Cl. ..... 273/1 GG

[58] Field of Search ..... 273/1 GG, 1 GD, 1 GC, 273/140

[56] References Cited

U.S. PATENT DOCUMENTS 3,249,357 5/1966 Luchsinger ..... 273/1 GD
3,853,321 12/1974 Claffie ..... 273/1 GD X
4,214,750 7/1980 Shimizu ..... 273/1 GD

FOREIGN PATENT DOCUMENTS 1186225 10/1985 U.S.S.R. ..... 273/1 GG
2063079 6/1981 United Kingdom ..... 273/1 GG

*Primary Examiner*—Paul E. Shapiro
*Attorney, Agent, or Firm*—Varndell Legal Group

[57] ABSTRACT

A fishing toy includes a base rotatably mounting thereon cylinders having vertical holes receiving therein respective toy fishes, a revolving structure eccentrically and rotatably mounted above the base and having side holes, a plurality of toy animals movably received in the structure and capable of protruding out of the structure from the respective side holes, and a revolving cam rotatably mounted in the structure for periodically protruding the animals out from the side holes so that to fish on the base is made difficult.

4 Claims, 3 Drawing Sheets

FISHING TOY

BACKGROUND OF THE INVENTION

The present invention relates to a toy, and more particularly to a fishing toy.

In the present market, one can find a fishing toy having a base rotatably mounting thereon a plurality of cylinders each of which includes a plurality of vertical holes each of which receives therein a toy fish capable of rising and diving and/or closing and opening its mouth attaching thereto a magnet. Upon playing, the player tries to fish the toy fishes by a fishing rod fixing thereto a fishing thread fastening thereto a magnet capable of attracting the magnet in the toy fish. Only when the toy fish rises and opens its mouth and the two respective magnets of the toy fish and the fishing rod are suitably matched together, can the player successfully fish the toy fish. One skilled in such playing, however, will feel such known fishing toy dull.

It is therefore attempted by the Applicant to make the fishing on a fishing toy difficult.

SUMMARY OF THE INVENTION

It is therefore an object of the present invention to provide a fishing toy requiring a better fishing skill.

According to the present invention, a fishing toy includes a base rotatably mounting thereon cylinders having vertical holes receiving therein respective toy fishes, a revolving structure rotatably mounted above the base and having side holes, a plurality of toy animals movably received in the structure and capable of protruding out of the structure from the respective side holes, and a revolving can rotatably mounted in the structure for periodically protruding the animals out from the side holes so that to fish on the base is made difficult.

The present invention may best be understood through the following description with reference to the accompanying drawings, in which:

DETAILED DESCRIPTION OF THE PREFERRED EMBODIMENT

Figure 1:
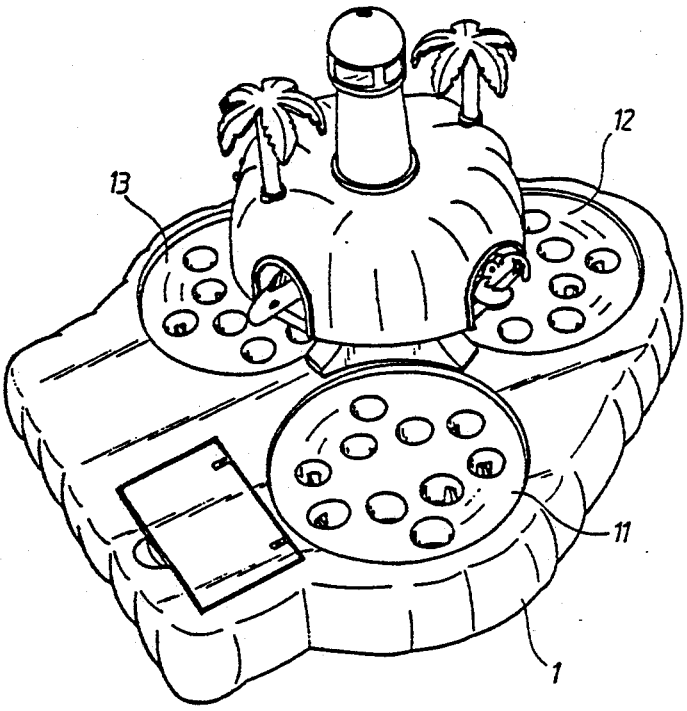
FIG. 1 is a perspective view showing a preferred embodiment of a fishing toy according to the present invention.
Figure 2:
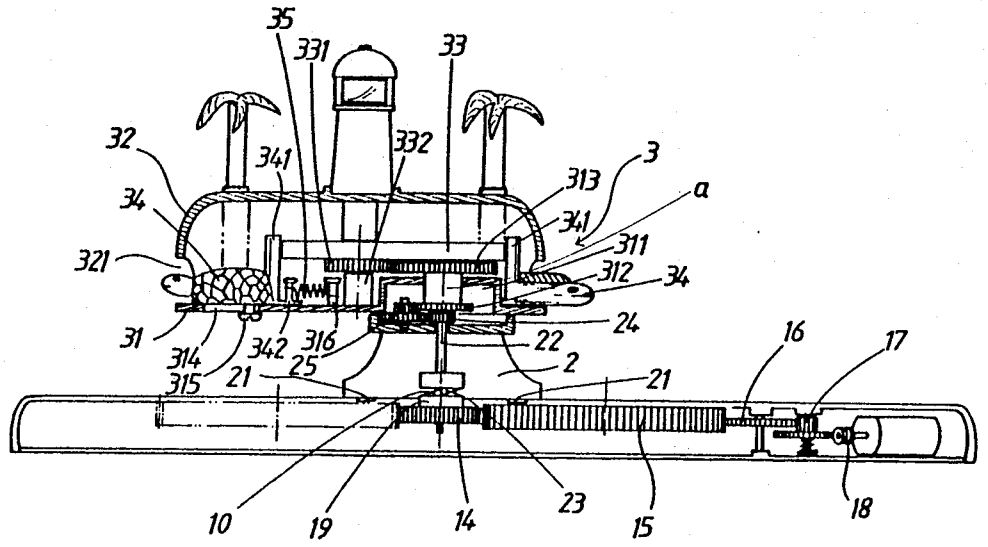
FIG. 2 is a sectional view showing a fishing toy in FIG. 1.
Figure 3:
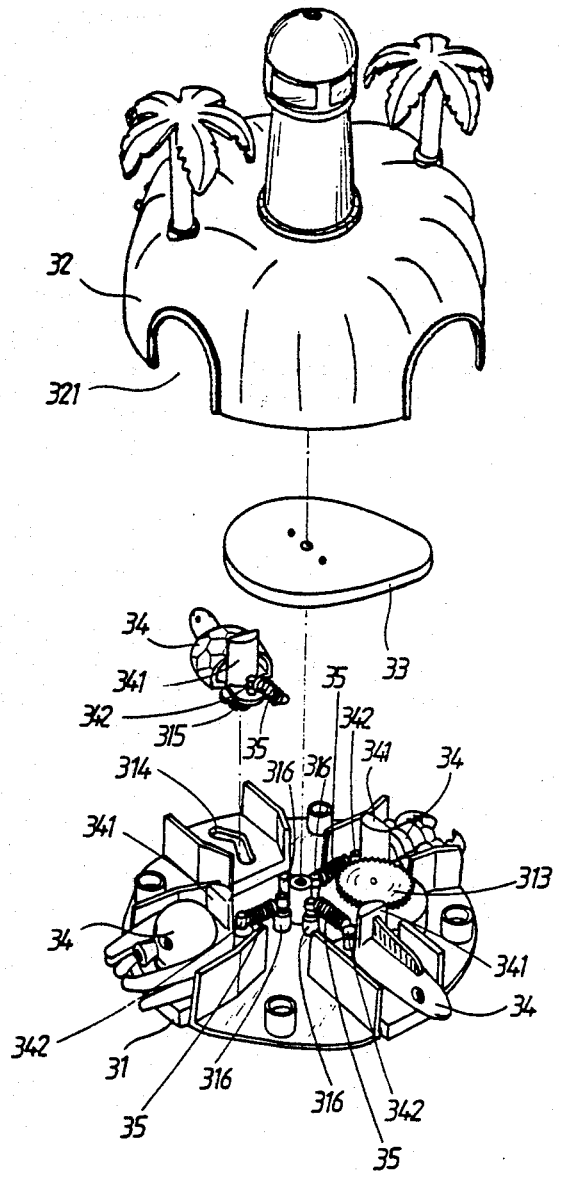
FIG. 3 is an exploded view showing a fishing toy in FIG. 1.

Referring now to FIGS. 1–3, a fishing toy according to the present invention includes a base 1, a mounting 2 and a revolving structure 3. Base 1 rotatably mounts thereon 3 cylinders 11, 12 and 13 each of which is connected at the bottom thereof to a gear 15 and includes a plurality of vertical holes each of which receives therein a toy fish at the prior art, and also rotatably mounts therein a central gear 14 which includes a transmission medium 19 having an engaging piece 10 and simultaneously meshes with the bottom gears connected to cylinders 11, 12 and 13.

Mounting 2 is positioned on base 1 by the provision of a plurality of bottom protuberances 21 engaging in corresponding indentations on base 1 and includes a central spindle 22 which has a bottom engaging piece 23 engaging with engaging piece 10 and a top gear 24 meshing with a gear assembly 25. The upper portion a is jointed with the top portion of an eccentrical room 311 (described hereinafter) so as to make the moving function of revolving structure 3.

Revolving structure 3 includes an upper housing 32, a lower housing 31, a plurality of toy animals 34 (e.g. tortoise, shark, lobster, octopus ... etc.) and a revolving cam 33. Lower housing 31 is eccentrically and rotatably mounted on mounting 2 and includes multiple curved grooves 314 and an eccentrical room 311 having a shafted gear 312 which meshes with gear assembly 25 and carries a synchonous gear 313. Upper housing 32 includes multiple side holes 321. Each toy animal 34 is movably guided in one respective curved groove 314 by screwing thereto a screw 315 from the bottom of lower housing 31 and capable of protruding out of upper housing 32 from one respective side hole 321, and includes an upright projection 341 and a tail protrusion 342. Revolving cam 33 is rotatably mounted in structure 3 for engaging with upright projections 341 of and periodically protruding animals 34 out from respective side holes 321, and includes a shaft 332 which has a gear 331 meshing with gear 313 and around which there are provided with a plurality of adjacent projections 316. Between each respective projection 342 of an animal 34 and projection 316, there is provided with a spring 35 for urging the respective upright projection 341 of a respective animal 34 against the surface of cam 33.

When the gearedly shafted motor 18 in base 1 is energized, through a gear assembly 17 and an intermediate gear 16 meshing with gear 15 of cylinder 11, it will rotate cylinders 11, 12 and 13, structure 3 and cam 33 so that respective toy fishes in respective vertical holes in cylinders 11, 12 and 13 will rise and dive periodically and/or close and open their mouths and animals 34 will be set in periodical protrusion from respective side holes 321. Since structure 3 is revolving above base 1 and animals 34 are in curvy protrusion from side holes 321, the interference on the fishing of a player on base 1 is greatly enhanced.

Through the above description, it can now be realized how and why the present invention can achieve its objects.

What I claim is:

1. A fishing toy comprising:

a base rotatably mounting thereon a plurality of cylinders each of which includes a plurality of vertical holes each of which receives therein a toy fish;

a revolving structure rotatably mounted above said base and having a plurality of side holes;

a plurality of toy animals movably received in said structure and capable of protruding out of said structure from said respective side holes; and a revolving cam rotatably mounted in said structure for periodically protruding said animals out from said side holes so that to fish on said base is made difficult.

2. A fishing toy as claimed in claim 1 wherein said structure is eccentrically mounted above said base, said structure includes a plurality of bottom grooves for respectively guiding said animals and each of said animals includes an upright projection engaging with said cam, and said grooves are curved so that said animals can have a curvy movement.

3. A fishing toy as claimed in claim 1 wherein said cam has a shaft and said toy further includes a spring mounted between said shaft and one of said animals, and said structure further includes a protrusion located between said protrusions.

4. A fishing toy as claimed in claim 1 wherein the bottom of each said cylinder is connected to a gear and said base mounts therein a central gear simultaneously meshing with said gears of said cylinders, and the revolution of said revolving structure and cam is actuated by said central gear through respective gear trains.

* * * * *